United States Patent [19]

Ishiguro

[11] 4,250,659

[45] Feb. 17, 1981

[54] PENDOULOUSLY SUPPORTED MAGNETICALLY ACTUATED FIGURINE

[75] Inventor: Tamezo Ishiguro, Matsudara, Japan

[73] Assignee: Otagiri Mercantile Company, Inc., San Francisco, Calif.

[21] Appl. No.: 60,321

[22] Filed: Jul. 25, 1979

[51] Int. Cl.[3] ..... A63H 33/26

[52] U.S. Cl. ..... 46/238; 273/1 M

[58] Field of Search ..... 46/236, 238, 239, 240, 46/242; 40/426; 273/1 M

[56] References Cited

U.S. PATENT DOCUMENTS

| | | | |
|---|---|---|---|
| 2,107,672 | 2/1938 | Lang | 46/236 UX |
| 2,220,049 | 10/1940 | Dunmore | 46/239 X |
| 3,707,290 | 12/1972 | Birnkrant | 46/239 X |
| 3,908,307 | 9/1975 | Jacobson | 46/238 |

FOREIGN PATENT DOCUMENTS

| | | | |
|---|---|---|---|
| 574516 | 3/1958 | Italy | 40/426 |

*Primary Examiner*—Gene Mancene
*Assistant Examiner*—Mickey Yu
*Attorney, Agent, or Firm*—Townsend and Townsend

[57] ABSTRACT

A magnetically actuated toy is disclosed in the toy class including a supporting structure, a magnet disposed in the base of said supporting structure, an object (preferably a figurine) having a coacting magnet attached thereto, and means for pendulously suspending the object from the base structure in a position to swing with the respective magnets opposed. In this structure, an improvement includes in the pendulous support a rigid (or rod) segment and a torsion segment (or member). The magnet in the object and base are placed with poles opposed. The center of gravity of the suspended object lies off-axis to the forces between the opposed magnets on the object and the base. The torsion member, forming the second part of the pendulous support, is typically a short nylon string. Kinetic energy of the object exists in two arcuate forms; pendulous motion and rotational pendulous motion. Potential energy of the object exists in two forms; the vertical elevation of the object above the platform as result of the twisting of the torsional segment and the vertical elevation of the object above the platform as a result of the arcuate pendulous motion. Successive unpredictable discharges and transformations of the above four types of potential and kinetic energy in the swinging, twirling object provides lifelike motions to such object. Various objects are disclosed, including a figurine on a skateboard, a ballerina and paired disco dancers.

9 Claims, 4 Drawing Figures

PENDOULOUSLY SUPPORTED MAGNETICALLY ACTUATED FIGURINE

This invention relates to pendulously supported objects swinging over a base, wherein the object and base have coacting magnets. In particular, the disclosed invention discloses an improvement comprising an object, such as a figurine, having a center of gravity off-axis to the force between opposed magnets in combination with a segment of the support capable of receiving and storing torsional energy.

SUMMARY OF THE PRIOR ART

Francis W. Dunmore U.S. Pat. No. 2,220,049 entitled "Advertising Method and Magnetic Motivated Object" discloses the class of structure herein. In this application, a supporting structure is provided which includes a base and an overhead support point for pendulously supporting an object. The base has a magnet disposed therein. An object is pendulously supported from the support point and has a coacting magnet attached thereto. By swinging the object back and forth, coaction between the supported object and base result. In the preferred embodiment, the use of figures is disclosed together with a rotating motor. Polar alignments of the respective magnets are horizontal.

SUMMARY OF THE INVENTION

A magnetically actuated toy is disclosed in the toy class including a supporting structure, a magnet disposed in the base of said supporting structure, an object (preferably a figurine) having a coacting magnet attached thereto, and means for pendulously suspending the object from the base structure in a position to swing with the respective magnets opposed. In this structure, an improvement includes in the pendulous support a rigid (or rod) segment and a torsion segment (or member). The magnet in the object and base are placed with poles opposed. The center of gravity of the suspended object lies off-axis to the forces between the opposed magnets on the object and the base. The torsion member, forming the second part of the pendulous support, is typically a short nylon string. Kinetic energy of the object exists in two arcuate forms; pendulous motion and rotational pendulous motion. Potential energy of the object exists in two forms; the vertical elevation of the object above the platform as a result of the twisting of the torsional segment and the vertical elevation of the object above the platform as a result of the arcuate pendulous motion. Successive unpredictable discharges and transformations of the above four types of potential and kinetic energy in the swinging, twirling object provides lifelike motions to such object. Various objects are disclosed, including a figurine on a skateboard, a ballerina and paired disco dancers.

OTHER OBJECTS AND ADVANTAGES

An object of this invention is to disclose an improved alignment for the magnets coacting between a pendulously supported object swinging in close relation over a base. According to this aspect of the invention, the magnet in the base is placed with its poles vertically aligned. The object likewise has its magnet placed therein with its poles vertically aligned. The closest pole in the base and the closest pole in the object are like poles, which poles repel each other. With this configuration, an eccentric motion of the figurine about the base of the object occurs.

An advantage of the disclosed magnet alignment of the present invention is that pendulous movement never results in a rigid locking between the figurine and base. Instead, the supported object, in seeking a central position over the magnet, swings erratically as the opposed poles on the base and object repel one another.

A further object of this invention is to disclose an improved two-segment support between the object and the point of pendulous support. In accordance with this aspect of the invention, one portion of the support comprises a rigid metallic rod. The other segment of the support comprises a flexible torsion element, preferably a piece of nylon line. In the pendulous motion of the opposed magnets over one another, torsional energy is generated. This torsional energy is stored in and then released by the torsional segment of the support. Realistic spinning of the supported object as it swings over the magnet is produced, first in one direction, then in the opposite direction.

An advantage of this aspect of the invention is that the torsional segment of the support is capable of converting and then releasing the kinetic energy imparted to the object, such as a figurine. The object in motion acts as if it were alive. Before torsional energy is stored, wide and erratic spinning and swinging movement occurs. When torsional energy is fully stored, the wide motions of the figurine are reduced. It appears to have a lesser degree of energy. Finally, when the torsional energy is released, the figurine agains pick up wide and erratic spinning and swinging movement.

Another object of this invention is to disclose an improved alignment between the co-acting magnets and the center of gravity of the supported object. According to this aspect of the invention, the coacting magnet is disposed along one axis from the support point. The center of gravity of the supported object is disposed along a second and different axis which is not coaxial to and is off-axis from the axis of the magnet. Animated motion of the supported object results.

An advantage of the off-axis rigid support of this invention is the lifelike motion imparted. For example, when pendulous movement is first applied to a supported object such as a figurine, a conventional and wide swinging pendulous motion occurs. As the figurine passes over the base and the two opposed magnets coact, spinning of the figurine results. This spinning is accompanied by reduced linear excursion of the pendulum. Translation of the pendulum is converted into torsional motion of the pendulum.

Reconversion of the torsional motion of the pendulum back to linear motion of the pendulum occurs just as rapidly and erratically. The figurine at portions of its motions stops spinning and regains its linear motion. There results a peculiarly lifelike motion of the figurine.

Yet a further aspect of this invention is that when the swinging and spinning energy conversion occurs, the torsional segment stores and discharges energy. There results movement of the figurine in which energy is apparently discharged and then apparently regained. There results an extremely lifelike and convicting motion to a supported object such as a figurine.

Other objects, features and advantages of this invention will become more apparent after referring to the following drawings and attached specification in which.

Figure 1:
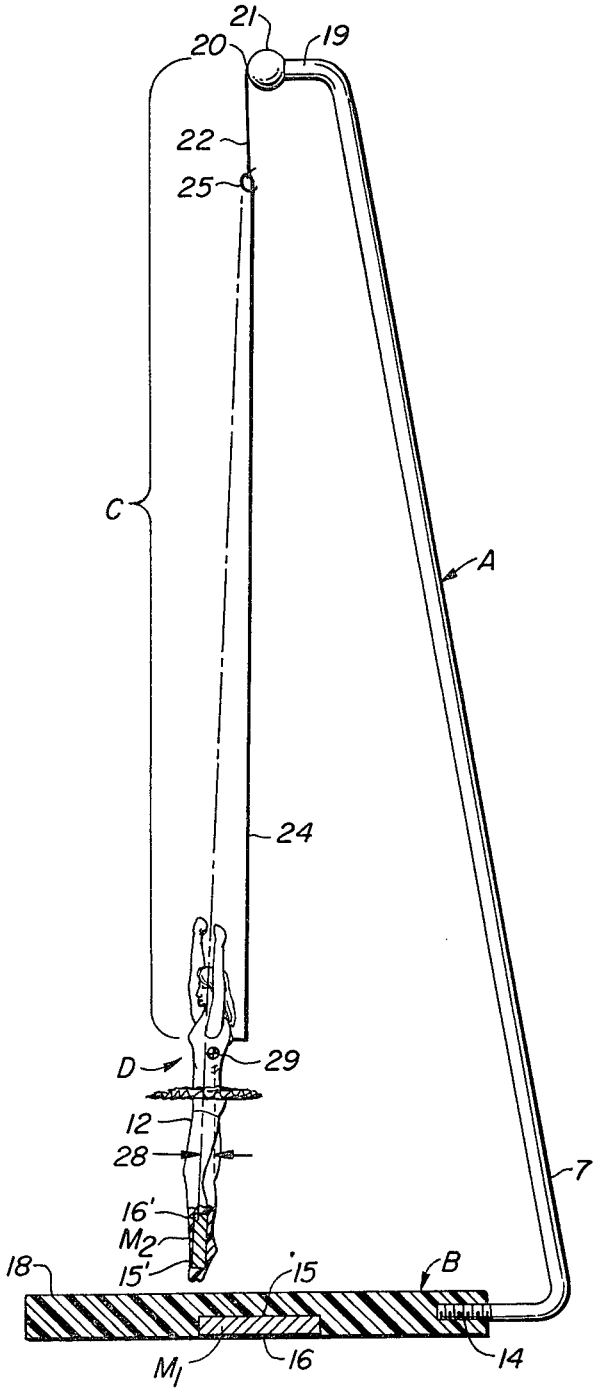
FIG. 1 is a side elevation such of the figurine of this invention particularly useful for describing the base, base magnet support, torsion segment of the support and rigid segment of the support segment, and the object having a magnet eccentric to its center of gravity therein.

Referring to FIG. 1, a rod A is illustrated attached at its bottom 14 to a base B. Rod A extends upwardly and at the furthermost extreme extends outwardly typically over the medial portion of the base B. A pendulous support C supports an object D over the base B. The object D is here shown as a ballerina 12.

The base includes a first magnet $M_1$. $M_1$ is preferably aligned with its respective poles along a vertical axis to the upper end of the support A. As here shown, north pole 15 is towards the object D.

The object D likewise includes a second magnet $M_2$. This magnet has its north pole 15' disposed towards the base B with its south pole 16' away from the base B.

It may thus be seen that the magnets between the objects of the base are in opposition. Those having skill in the art will note that the figurine will never come to rest in the neutral position directly over the center of the base. Rather, the figurine will come to rest eccentrically of the base.

Figure 2:
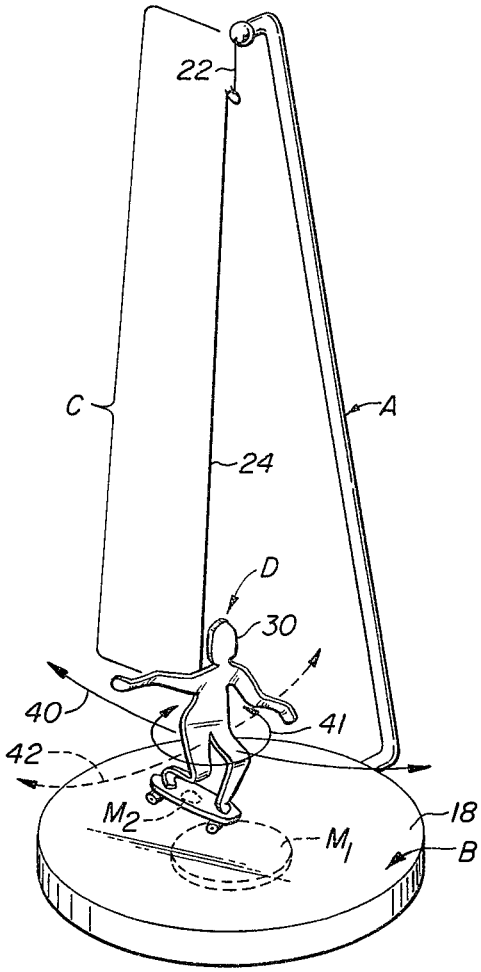
FIG. 2 is a perspective view of an alternate object supported over the base.

Referring briefly to FIG. 2, a preferable shape of the base is a circular configuration 18. Typically, the base is weighted so there is no danger of overturning, no matter what original excursion is imparted to the pendulously supported object D.

Rod A is typically fastened to the side of the base. It is rigidly affixed thereto. As here shown, rod A extends horizontally outward from the base and then upwardly along a segment 17 at an angle of approximately 15° from the vertical. At portion 19, rod A extends outwardly. It extends outwardly and over the medial portion of the circular configuration 18 comprising the base B.

The pendulous support C attaches from the upper end of the support member A to the object D. This support C includes at least two distinct segments.

First, this pendulous support member C includes a torsion member 22. Preferably member 22 is a piece of nylon line. Member 22 at its upper end is affixed interiorly to a sphere 21 with cylindrical aperture impressed over the end of the rod A. The torsion member 22 is gripped by the sphere 21 sufficiently so that no rotation of the torsion member 22 can occur where attachment to the sphere 21 occurs, support point 20.

At the lower end, torsion member 22 fastens to a rigid rod segment 24. Typically fastening occurs at a ring or loop 25 formed by bending the upper end of the rod segment 24. With the tying of the torsion member 22 about the ring or loop 25, likewise no torsional relative movement can occur at the lower end of the torsion member 22 between the rod segment 24 and the torsion member 22.

Stopping here and remembering that object D acts as a weight below, it can be seen that torsion member 22 acts as a torsional energy storage device in a torsional pendulum structure. As the object D is spun, torsional energy is stored in torsion member 22. When the object is released, torsional energy can likewise be released. The released, formerly stored or potential, torsional energy becomes kinetic torsional energy.

The rod segment 24 extends between the object D and the end of the torsion member 22. Several important observations can be made about the rod segment 24.

First, it will be noted that drawing a line from the second magnet $M_2$ in the object D to the support point 20, a center line 27 is described. It will be noted that this center line is off-axis from and not coincident to the center of gravity 29 of the object D. Stated in other terms, there is a lever arm 28 described between the center of gravity 29 and the center line 27. As will hereinafter be emphasized, this is extremely useful in imparting spinning and lifelike motions to a figurine.

Secondly, the rod segment 24 extends into and is rigidly embedded within the object D. There is no relative motion permitted between the rod segment 24 on one hand and the object D on the other hand.

Having described the parts and alignment of the parts as they relate to this invention, we can now devote attention to the kinematics of motion produced.

Referring to FIG. 2, the unusual kinematic and/or dynamic motion of the supported object, here shown as a skateboard figurine 30 are illustrated. Assuming that initially a pendulous movement is imparted to object D along a pendulous path of arcuate motion 40, and in the absence of the magnets $M_1$, $M_2$, it will be realized the figurine will swing to and fro in a substantially undisturbed manner along a path with acruate motion 40. At the extremes of swing, the body will be instantaneously at rest and have its energy stored in the form of potential energy. In the medial portion, the body will swing with a maximum velocity and have converted the potential energy into kinetic energy. Swinging back and forth would occur until frictional forces damp the swing sufficiently to halt the swinging.

With the coacting and opposing magnets $M_1$, $M_2$ therein, deviation of the body motions will occur. Specifically, and by way of example, motion along a path described by arcuate motion 40 can just as easily be deflected to a path 42. This motion will relatively abruptly occur as the opposed magnets $M_1$, $M_2$ at their opposed poles repel one another.

A third form of motion, spinning or twirling, will likewise occur. It is a direct result of the lever arm 28 produced between the center of gravity 29 on one hand and the center line 27 on the other hand. Especially when the lever arm 28 is at right angles to the path of swing, spinning motion will be imparted. This is shown on FIG. 2 by spinning motion 41.

To understand this imparting of spinning motion, reference is made to FIG. 1. Assuming that the figurine therein displayed swings into and out of the paper, it will be seen that the lever arm 28 is at a right angle to the path of swing. As the object D, with its magnet $M_2$, swings by the base B, with its magnet $M_1$, a spinning motion is imparted to the object D.

Stopping here it can be understood that dependent upon the location of the center of gravity and the length of the lever arm, the swing may be slow or rapid, great or small. Further, and depending upon many factors including the angle of the lever arm 28 to the path of swing, the relative location of the magnets $M_1$ and $M_2$, the speed and direction of pendulous motion, the torsional energy stored, and so forth, the torsional energy imparted to the object D may from time to time be recovered. When it is recovered, as by the supported object D spinning less, the pendulous motion is restored. Conversely, when spin is imparted to the object, the swinging pendulous motion is reduced. There results an erratic and random motion of the object including first torsional spinning, second pendular excursion, and combinations of both. The object thus has imparted to it a random and indeed lifelike motion.

Figure 3:
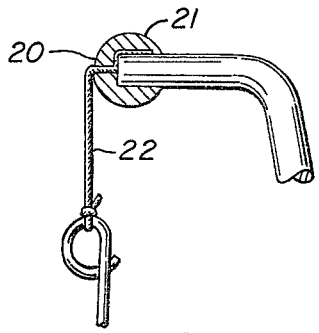
FIG. 3 illustrates the torsion segment of the support.

Referring to FIG. 3, it will be remembered that the torsion member 22 had the capability of storing torsional energy. Thus the random spinning motion can have part of its energy stored within the torsion member 22. At least two kinematic elements of motion are imparted by this torsional member 22.

First, the supported object D tends to spin first in one direction and then the other. This is especially true where the torsion member 22 is short.

Secondly, a further randomness to the motion results. When spin energy to a large degree is stored in the torsion member 22, either the pendular swing or the torsional spinning or both are reduced in the supported object D. Conversely, as torsional energy is discharged from the torsion member 22, torsional excursion of the supported object occurs. As has been emphasized before, this torsional excursion is readily reconverted into linear motion. A lifelike and very realistic motion of the object occurs.

It should be apparent to the reader that this invention will admit of alternate embodiments. For example, referring to FIG. 4, paired objects $D_1$, $D_2$ can be supported. Moreover, each object can have its own torsion segment. For example, a torsion segment 52 attached to object $D_1$ while a torsion segment 54 attaches to object $D_2$.

Figure 4:
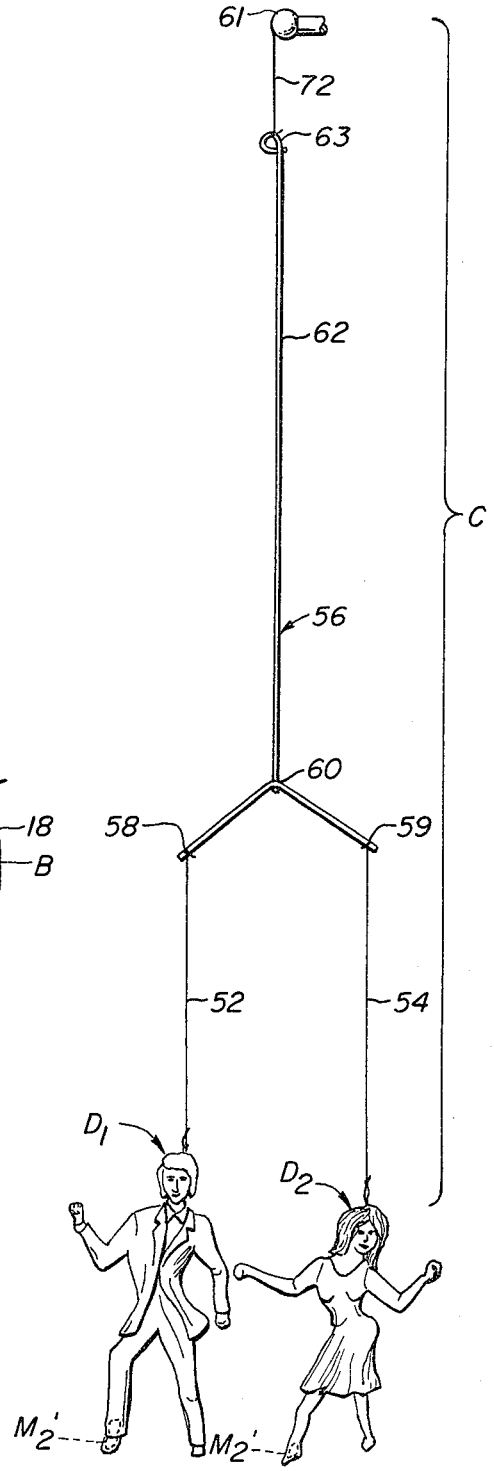
FIG. 4 is an alternate of the invention in which two objects, such as figurines, are supported with each each figurine having a support system including two torsion segments and one rigid segment.

It is likewise just as apparent the torsion segment can be anywhere in the support. For example and as illustrated in FIG. 4, a torsion segment 72 is included between a rigid support member 56 and a sphere 61.

The rigid member 56 may likewise be altered. For example in the configuration illustrated in FIG. 4, it is of an inverted Y-shape. It includes a first end 58 for supporting object $D_1$ a second end 59 for supporting object $D_2$. At the apex of the Y 60, support member 56 extends upwardly in a linear member 62 ending in a ring 63.

It can also be seen that the support member C can include for each object not one but two torsion segments. For example and by including the torsion segment 72 at the top, it can be seen that each object $D_1$, $D_2$ includes two torsion segments. For example, object $D_1$ includes torsion segment 72 and torsion segment 52 with support member 56 therebetween. Likewise, object $D_2$ includes torsion segment 72 and torsion segment 54 with support member 56 therebetween.

It can be thus seen, that over the prior art, the tortion segment, the eccentrically mounted rigid portion and the opposed coacting magnets all impart to the object an unusual and lifelike motion.

What is claimed is:

1. In the combination of a base, a rod having a first end embedded in the base and a second end over said base, said second end having a support point positioned medially over said base, an object supported over said base, pendulous support means between said object and said support point, coacting magnets, a first magnet in said base and a second magnet in said object, the improvement in said support means comprising:

said support means including a torsion segment having a tensive member capable of receiving, storing, and discharging torsional energy from said supported object; said support means including further a rigid segment not capable of storing appreciable torsional energy; said object having a center of gravity eccentric from a line extending between said support point and said second magnet on said object whereby pendular movement of said supported object can be converted to spinning motion of said object.

2. The invention of claim 1 and wherein said support means includes two torsional segments.

3. The invention of claim 1 and wherein said support means supports two objects.

4. The invention of claim 1 and wherein said rigid segment of said support means has an inverted Y-shape comprising a vertical portion and two arms, said vertical portion of said inverted Y-shape disposed towards said support point and at least one of said arms of said Y supporting at an extreme end thereof a supported object.

5. A combination comprising:

a base;

a rod having a first end embedded in said base and a second end extending over said base; said second end having a support point positioned medially over said base;

pendulous support means depending from the support point of said rod including a rigid portion and a torsional segment;

an object supported by said pendulous support means immediately over said base;

a first magnet having a substantially vertical polar alignment affixed to said base;

a second magnet affixed to said object, said second magnet having a substantially vertical polar alignment; said magnet in said base and said magnet in said object having like poles disposed towards one another whereby said poles repel; said pendulous support means including a torsional segment for receiving, storing, and discharging torsional energy from said object; said rigid portion rigidly attached to said object at the lower end thereof; said object including a center of gravity non-concentric to an axis described between said support point and said second magnet whereby spinning motion can be imparted to said object from pendular motion of said object.

6. The invention of claim 5 and wherein said object is a figurine.

7. The invention of claim 5 and wherein said object is a figurine on a skate board including a magnet affixed to said skateboard.

8. The invention of claim 5 and wherein said pendulous support means includes one torsional segment in said support means.

9. In a toy of the type having a base and a support member extending upwardly from said base for pendulous support of an object, comprising:

a first magnet affixed to said base;

a second magnet affixed to said object, said first and second magnets having poles in parallel alignment with adjacent poles being of like polarity whereby said magnets repel one another; said support member having a support point positioned centrally over said base;

a pendulous support means extending between said object and said support point, said pendulous support means including a torsional portion and a rigid portion, said torsional portion including first and second torsionally fixed ends with a flexible length therebetween capable of receiving, storing, and discharging torsional energy from said supported toy; said rigid portion extending to and rigidly affixed to said object from said torsional portion; said second magnet on said object being eccentric to an axis described between said support point and the center of gravity of said object and second magnet therewith whereby spinning motion can be randomly imparted to and/or recovered from said object.

* * * * *